United States Patent [19]

Pesonen et al.

[11] 4,416,731

[45] Nov. 22, 1983

[54] APPARATUS FOR CONTROLLING THE POSITION AND LOCATION OF A STATIONARY DEVICE OF A PAPER MACHINE WHICH ACTS ON A PAPER WEB BEING MANUFACTURED THEREIN

[75] Inventors: Jori Pesonen, Helsinki; Markku Koivumäki, Jyväskylä, both of Finland

[73] Assignee: Valmet OY, Finland

[21] Appl. No.: 376,537

[22] Filed: May 10, 1982

[30] Foreign Application Priority Data

Nov. 25, 1981 [FI] Finland ..... 813764

[51] Int. Cl.[3] ..... D21F 1/48; D21F 1/54

[52] U.S. Cl. ..... 162/308; 162/312; 162/352; 162/374

[58] Field of Search ..... 162/352, 374, 253, 312, 162/361, 308, 252

[56] References Cited

U.S. PATENT DOCUMENTS

| | | | |
|---|---|---|---|
| 3,323,981 | 6/1967 | Heys | 162/352 |
| 3,323,982 | 6/1967 | Hell | 162/352 |
| 3,535,201 | 10/1970 | Reynolds et al. | 162/352 |

*Primary Examiner*—Steve Alvo

*Attorney, Agent, or Firm*—Steinberg & Raskin

[57] ABSTRACT

Apparatus for controlling the position and location of a stationary device extending across the transverse dimension of a web in a paper machine for acting on the web during operation of the paper machine and by which the distance of the device from the web and/or its angular position is adjusted. The control apparatus is provided at both transverse ends of the frame of the stationary device and comprises a slide member assembly including a first slide member which supports the frame portion of the stationary device, a second slide member supported on the frame of the paper machine and an intermediate slide member situated between the first and second slide members and slidably engaging the same at respective engaging pairs of sliding surfaces thereof. The intermediate slide member and one of the first and second slide members have opposed engaging curved sliding surfaces, the center axis of such curvature substantially coinciding with a straight line defining the tip edge of the stationary device. The intermediate slide member and the other of the first and second slide members have opposed engaging slide surfaces which are straight in their direction of movement. An adjusting assembly is provided for displacing the intermediate slide member and one slide member along the curved sliding surface in order to adjust the angular orientation of the stationary device and for displacing the intermediate slide member and the other slide member with respect to each other along the straight sliding surface to adjust the distance of the stationary device from the web independently of the angular orientation of the stationary device.

9 Claims, 5 Drawing Figures

APPARATUS FOR CONTROLLING THE POSITION AND LOCATION OF A STATIONARY DEVICE OF A PAPER MACHINE WHICH ACTS ON A PAPER WEB BEING MANUFACTURED THEREIN

BACKGROUND OF THE INVENTION

The present invention relates to apparatus for controlling the position and location of a stationary device constituting a component of a paper machine and which acts on the web being manufactured or on a fabric carrying the web over a dimension thereof transverse to the direction of travel of the web.

More particularly, the present invention relates to position and location controlling apparatus by which the distance of a stationary device from the web or fabric and/or the angular orientation of the stationary device is controlled and wherein a frame portion of the stationary device is carried on both ends of the frame structure of the paper machine through the mediation of the control apparatus.

As used herein, a stationary device acting on a web will be understood as including a device which will influence the web, e.g., the dewatering of the web or the running of the web, without substantially directly contacting the same.

In the illustrated embodiment of the apparatus of the present invention, the stationary device constitutes a dewatering element employed on the wire section of the paper machine. However, it is understood that the present invention is also applicable to controlling the position and location of other devices which affect the web and its running, e.g., in connection with the drying of the web.

Regarding the state of the art with which the present invention is concerned, reference is made by way of example to U.S. Pat. Nos. 3,323,982 and 3,535,201, both of which concern dewatering elements situated in the wire section of the paper machine. More particularly, U.S. Pat. No. 3,323,982 discloses apparatus for adjusting the height of a foil strip relative to a web including control screws and wherein a beam carrying the foil strip is connected to the paper machine frame by swivel bearings so that the foil beam as a whole can be tilted around the bearing. However, since an adjustment in the angular orientation of the foil will also unavoidably result in an adjustment in the height of the foil, the precise control of the position and location of the foil strip is complicated and time-consuming.

U.S. Pat. No. 3,535,201 discloses an arrangement wherein the ends of the beam which carry the foil strip are each affixed tothe frame structure by two screws which pass through elongated holes. In order to adjust the angular orientation of the foil strip, the latter can be turned in curved guides which are arranged such that adjustment of the foil angle will not affect the height position, i.e., the distance of the foil strip from the web. Rather, in this arrangement, the height of the foil strip is adjusted by means of separate control screws.

Both of the arrangements described above have the drawback that the control screws employed to control the position and location of the foil strip fail to provide a surficiently rigid and sturdy support of the foil beam on respective substructures. Moreover, the accuracy of the adjustment of the position of the foil strip as well as the ease with which such adjustments are made in the prior art arrangements discussed above also leave room for improvement.

SUMMARY OF THE INVENTION

Accordingly, one object of the present invention is to provide new and improved apparatus for controlling the position and location of a stationary device which constitutes a component of a paper machine which apparatus avoids the drawbacks of the conventional ones discussed above.

Another object of the present invention is to provide new and improved control apparatus by which adjustments of one or both of the distance of a stationary device, such as a dewatering element, from the web and the angular orientation of the device can be effected independently of each other thereby providing a faster and more accurate adjustment of the position and location of the stationary device.

Still another object of the present invention is to provide new and improved control apparatus which provides sufficiently rigid support for a stationary device, such as a dewatering element, so that the tendency of the stationary device to vibrate is substantially reduced relative to such tendencies in conventional apparatus.

Briefly, in accordance with the present invention, these and other objects are attained by providing control apparatus at each of the respective transverse ends of the frame portion carrying the stationary device, the control apparatus being constituted by a slide assembly including a first slide member supporting the frame portion of the stationary device, a second slide member supported by the frame structure of the paper machine, and an intermediate slide member situated between and slidably engaging the first and second slide members. The intermediate slide member has two sliding surfaces of which one is curved and the other is linear or straight. The intermediate slide member and one of the first and second slide members engage each other along a slide surface having a cylindrical segment configuration, the axis of the center of curvature of which substantially coincides with a straight line defined by the tip edge of the stationary device or which is closely proximate thereto. The intermediate slide member and the other of the first and second slide members engage each other along a slide surface which is linear in its direction of motion.

Adjusting apparatus are provided whereby on the one hand the one of the first and second slide members and the intermediate slide member can be displaced with respect to each other along the curved slide surfaces in order to adjust the angular orientation of the stationary device and, on the other hand, the other of the first and second slide members and the intermediate slide member can be displaced with respect to each other along the linear surface to adjust the distance of the stationary device from the web independently of the angular orientation of the stationary device.

It is understood that the stationary device referred to above whose location and position is adjusted by the control apparatus of the present invention may include all types of devices and means which "influence" the web and its running through the paper machine. For example, the stationary device may be constituted by dewatering elements, e.g., so-called foils, by the aid of which water contained in a wet web is drained therefrom while the web is supported by the paper machine wire or equivalent element. Moreover, the stationary device may constitute a so-called air foil by the aid of which the running of an air-supported web is influenced in a paper machine or in a drying apparatus for so-called coated or surface-sized paper.

Control apparatus in accordance with the present invention as described above, provides the capability of adjusting both the angular orientation as well as the location of the stationary device acting on the web independently of each other, i.e., so that an adjustment of the angular orientation, for example, will not cause an adjustment to be made in the location of the stationary device relative to the web. Moreover, the provision of a slide assembly defining two pairs of engaging slide surfaces, one pair being curved and the other pair being straight or linear, enables the adjustment of the position and location of the stationary device to be made in a highly accurate manner. It is also noted that the curved and straight slide surfaces will have a relatively large area so that when the various slide members are locked together, an extremely rigid supporting action no play is obtained for the upper, intermediate and lower slide members with the result that the vibration tendency of the stationary device, e.g., of the foil, is substantially reduced even at high paper machine speeds.

It should be noted in this connection that although the illustrated preferred embodiment utilizes a slide assembly having upper, intermediate and lower slide members, it may in some circumstances be advantageous to embody the invention in a manner such that the upper and lower slide members and their functions are interchanged and it will be understood that such an embodiment is within the scope of the present invention.

DESCRIPTION OF THE DRAWINGS

A more complete appreciation of the present invention and all of the attendant advantages thereof will be readily understood by reference to the following detailed description when considered in connection with the accompanying drawings in which.

DESCRIPTION OF THE PREFERRED EMBODIMENTS

Figure 1:
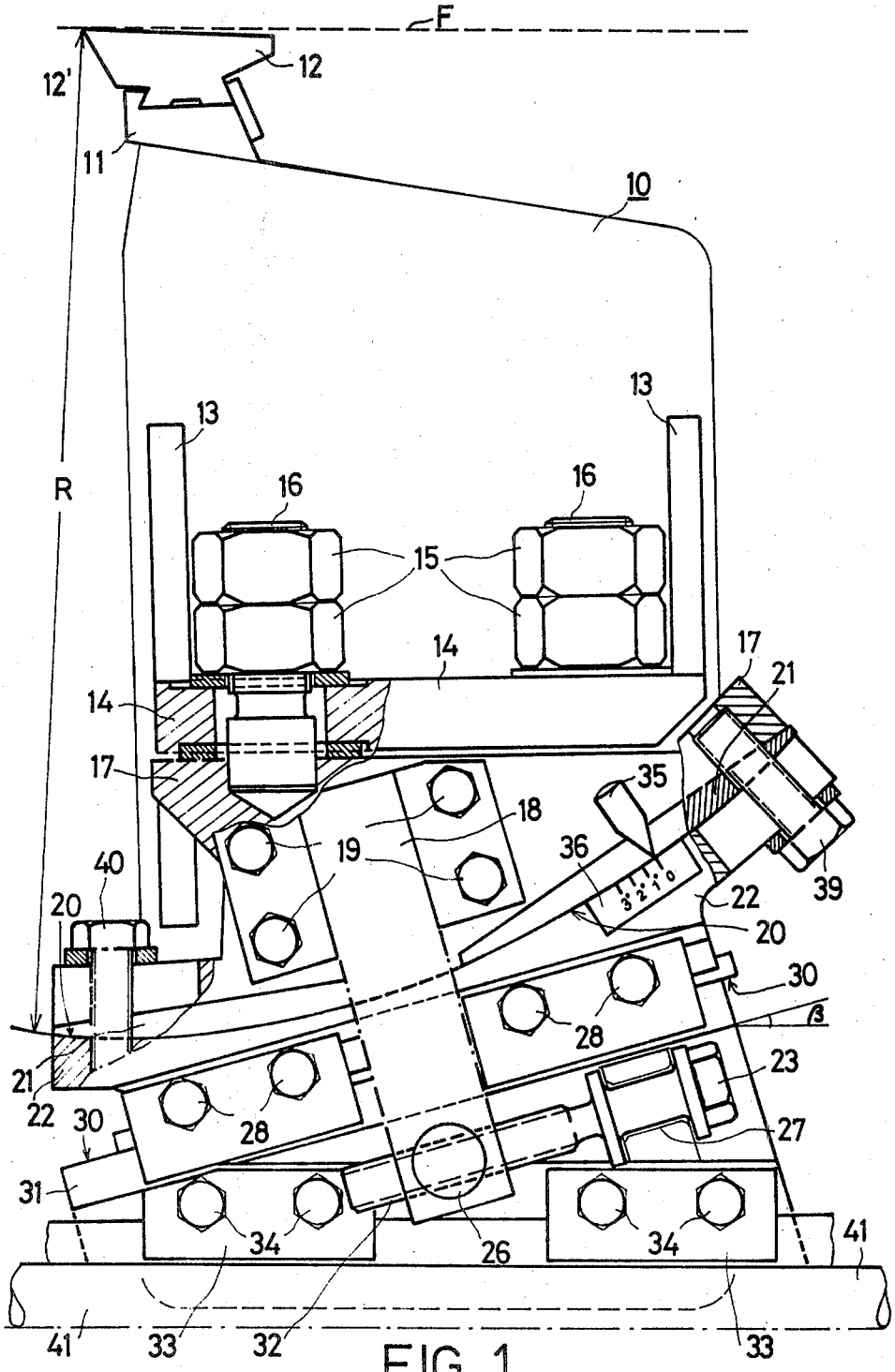
FIG. 1 is a schematic elevation view in partial section of control apparatus according to the present invention and shown in connection with a so-called foil in a forming wire section of a paper machine.
Figure 3:
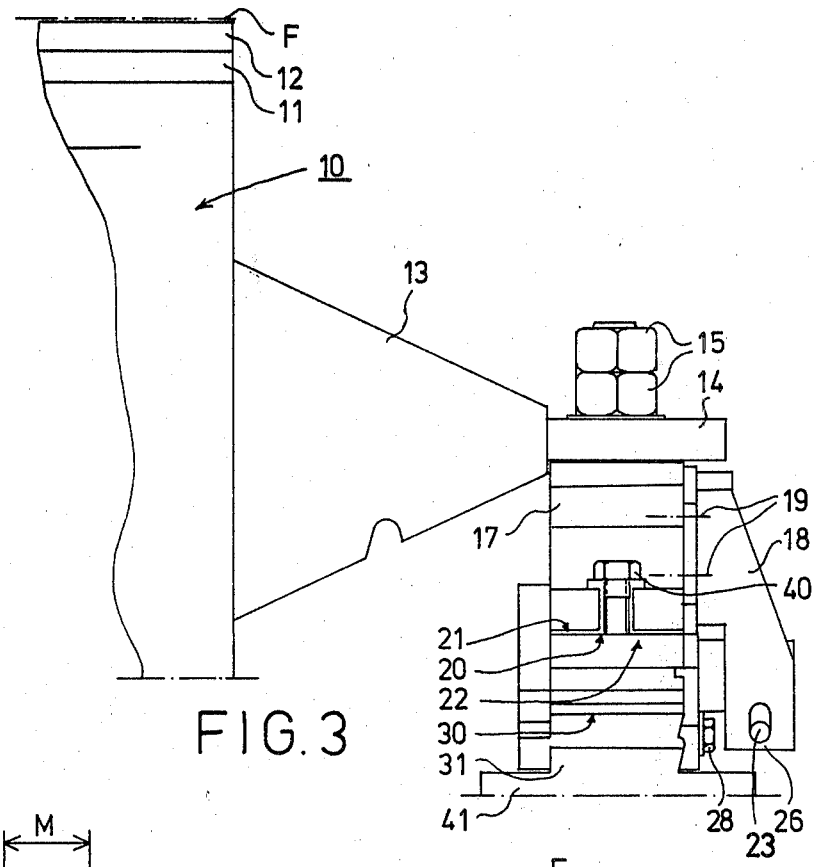
FIG. 3 is an elevation view of the embodiment of the control apparatus illustrated in FIG. 1 viewed in the machine direction.

Referring now to the drawings wherein like reference characters designate identical or corresponding parts throughout the several views, and more particularly to FIGS. 1 and 3, the control apparatus is illustrated in conjunction with a stationary device constituted by foil means disposed within the loop of a forming wire F of a paper machine such, for example, as a standard planar (Fourdrinier) wire. The foil means includes a box-type frame beam 10 which extends transversely to the direction of run of the wire, a rail 11 affixed to the top surface of the frame beam 10 on which a ceramic foil strip 12, which may be either continuous or assembled from a plurality of pieces or the like, is mounted in a manner known in the art. The front edge or tip of the foil strip 12 is designated 12'.

As seen in FIGS. 1 and 3, a mounting flange 13 is fixed to each transverse end of the frame beam 10 and a horizontal flange 14 is connected to each mounting flange 13. A pair of elongated holes are formed through each of the horizontal flanges 14 through which threaded pins 16 pass. The pins 16 serve to fix the frame beam 10 at each of its ends over the control apparatus of the present invention by means of the nuts 15 and so that the control apparatus is contiguous with the frame structure 41 of the paper machine.

As noted above, control apparatus in accordance with the present invention are provided at each of the transverse ends of the frame beam 10 and it will be understood that the control apparatus on the operator's side of the machine will constitute a mirror image of the control apparatus provided on the drive side of the paper machine. It will be further understood that both sets of control apparatus will be operated substantially simultaneously with a view toward adjusting the height of the foil strip 12, i.e., the distance between the foil strip 12 and the wire designated H in FIG. 4A, and/or the clearance angle or angular orientation of the foil strip 12, designated $\alpha$ in FIG. 4B, in a manner which will become apparent herein below.

The embodiment of the control apparatus illustrated in FIGS. 1 and 3 is constituted by a slide assembly including an upper slide member 17, an intermediate slide member 22 and a lower slide member 31. The horizontal flanges 14 of the frame beam 10 of the stationary device are affixed to the frame of the upper slide member 17 by the threaded pins 16 and corresponding nuts 15 described above. Thus, the threaded pins 16 pass through the elongated holes formed in the flange 14 so that the position of the frame beam 10 with respect to the upper slide 17 can be suitably adjusted and fixed.

According to the present invention, the upper slide member 17 and the intermediate slide member 22 have cylindrical segment shaped sliding surfaces 20 which slidably engage each other. The sliding surface 20 of the upper slide member 17 is constituted, for example, by slide blocks 21 formed of bronze or the like while the sliding surface 20 of the intermediate slide 22 is preferably formed of stainless stell or the like. On the other side, the intermediate slide member 22 and the lower slide member 31 have linear shaped or straight sliding surfaces, designated 30, which slidably engage each other. Thus, the sliding surface 30 of the intermediate slide member 22 may be formed of a slide block formed of bronze or the like while the sliding surface 30 of the lower slide member 31 preferably constitutes a stainless steel face or the like.

Moreover, the cylindrical segment sliding surfaces 20 of the upper and intermediater slide members 17 and 22 have a radius of curvature R (FIG. 1), the center axis of this curvature substantially coinciding with the tip 12' of the foil strip 12. Due to the curvature of the sliding surfaces 20, when the upper slide member 17 is adjusted in position with respect to the intermediate slide member 22 along the sliding surfaces 20, the height H of the stationary member 12, i.e., the distance of the foil 12 from the wire F, will remain the same while the adjustment of the angular orientation or clearance angle $\alpha$ is being made.

The intermediate slide member 22 may be moved in a substantially linear direction along the inclined sliding surface with respect to the lower slide member 31. The lower slide member 31 is itself affixed to the frame structure of the paper machine and, in particular, is affixed by fixing blocks 33 and screws 34 to a so-called register rail 41 which is affixed to the wire beam of the paper machine. By moving the intermediate slide member 22 on the linear, inclined sliding surface 30, the height position H of the foil strip 12 can be adjusted independently of the clearance angle $\alpha$ which the foil 12 defines with respect to the plane of the wire F.

In the illustrated preferred embodiment, adjustment apparatus are provided by which the upper slide member 17 as well as the lower slide member 31 are adapted to be displacable by means of a single control screw 23. The control screw 23 is mounted for free rotation with respect to the lower slide member 31 by means of a bearing component 27. A threaded block 26 is provided over a threaded portion 32 of the control screw 23, the threaded block 26 being fixed to a flange 18 whose upper end region is fixed by means of screws 19 to the upper slide member 17. It is noted that the flange 18 is not connected to the intermediate slide member 22.

Figure 4A:
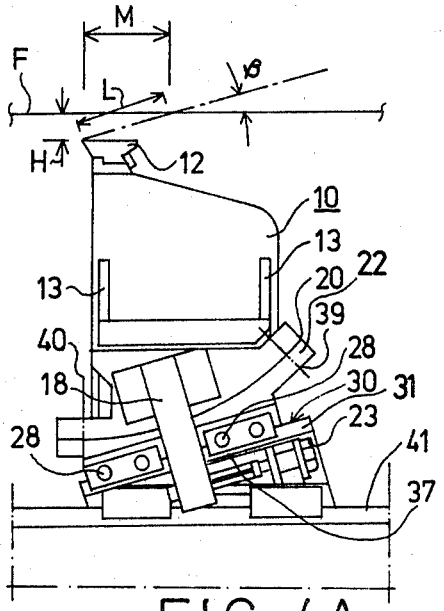
FIGS. 4A and 4B are schematic elevation views of the control apparatus illustrated in FIG. 1 illustrating the functioning thereof, FIG. 4A illustrating the control apparatus in an operating position in which the foil is lowered and FIG. 4B illustrating the foil in its upper position with the foil angle having been adjusted.
Figure 4B:
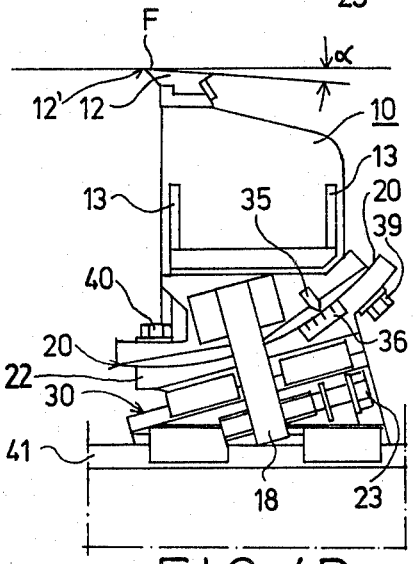

Referring to FIGS. 4A and 4B, the manner of operation and the construction of the control apparatus of the present invention will now be described. Referring to FIG. 4B, the clearance angle $\alpha$ which the foil strip 12 defines with the wire F is adjusted by first loosening screws 39 and 40 which, when tightened, lock the upper and intermediate slide members 17 and 22 to each other. It is understood that this as well as other operations described below are effected in both of the control apparatus, i.e., in the control apparatus both on the operator's side and on the drive side of the paper machine. The control screws 23 on both the operator's and drive sides of the paper machine are simultaneously rotated whereby the upper slide member 17 is displaced with respect to the intermediate slide member 22 under the urging of the flange 18 threadedly engaged with the control screw 23 through the threaded block 26. It is noted that during such operation, the intermediate slide member 22 is fixed with respect to the lower slide member 31 by screws 28, described below. In this manner, the foil strip 12 is turned until it subtends the desired clearance angle $\alpha$. It is further noted that since the axis of the center of curvature of the curved sliding surfaces 20 is substantially coincident with the tip edge 12' of the foil strip 12, the tip edge 12' will remain substantially in the same position at all times. A scale 36 and pointer 35 may be provided on the intermediate and upper slide members 22 and 17, respectively, so that the magnitude of the angle $\alpha$ can be readily ascertained. In the case of foil strips, the range of adjustment of the angle $\alpha$ may, for example, be about 0° to 30°. Upon completion of the adjustment of the clearance angle $\alpha$, the screws 39 and 40 are tightened thereby fixing the upper and intermediater slide members 17 and 22 to each other. The curved sliding surfces 20 preferably constitute a relatively large and stable supporting face between the upper and intermediate slide members so as to provide a sufficiently rigid support for the foil member.

Referring to FIG. 4A, during the adjustment of the height H of the foil 12, the screws 39 and 40 are in their tightened mode so that the upper and intermediate slide members 17 and 22 are fixed to each other. However, the screws 28 are loosened so that corresponding bearing plates extending between the intermediate and lower sliding members 22 and 31 are themselves loosened so that the intermediate and lower slide members can be moved with respect to each other. The controls screws 23 on both the operator's and drive sides of the paper machine are then simultaneously turned whereupon the upper and intermediate slide members 17 and 22, which are originally fixed to each other, are moved as a unitary assembly along the inclined straight sliding surfaces 30. The angle of inclination of the sliding surfaces 30 is denoted by $\beta$ in FIG. 4A and the magnitude of angle $\beta$ is preferably about 15°. By moving the unitary assembly constituted by the interlocked upper and intermediate slide member 17 and 22 with respect to the lower slide member 31 along the straight sliding surfaces 30 over a distance designated L, the height H of the foil strip is adjusted vertically, i.e., in the plane forming a right angle to the wire or fabric F, by a distance $H=L\times\sin\beta$. Of course, such adjustment also results in the position of the foil strip 12 changing in the plane of the wire F through the distance $M=L\times\cos\beta$. However, such displacement in a direction parallel to the plane of the wire F will have no adverse effect in practice since the distance in the horizontal plane and in the machine direction between two foils following each other substantially exceeds the distance M. After the adjustment of the height H of the foil 12 is completed, the screws 28 are tightened so that the bearing plates associated therewith will bear against the intermediate and lower sliding members 22 and 31 to lock the same to each other. It is noted that the adjustment of the height H of the foil is accomplished completely independently of the angular orientation of the foil, i.e., the clearance angle remains the same during such height adjustment.

In order to calibrate the scale 36 indicating the clearance angle $\alpha$ and a scale (not shown) indicating the height H of the foil strip, the position and location of the foil strip 12 can be initially set such that the foil angle equals zero with the upper planar surface of the foil strip 12 being substantially in the plane of the wire F. At this time, the scales indicating the angle $\alpha$ and the height H and/or the respective pointers associated therewith, are fixed so as to give a zero reading.

The structural arrangement of the control apparatus disclosed herein is particularly well suited for use in connection with existing foil beams due to the manner in which the same are attached to the upper slide member and transverse ends of the foil structure. When the control apparatus is provided on a new foil member, the arrangement can be provided in a simpler and less expensive manner such, for example, as by constructing the upper slide member so as to be integral with the foil beam. In such a case, it is advantageous to change the locations of the sliding surfaces 20 and 30.

Figure 2:
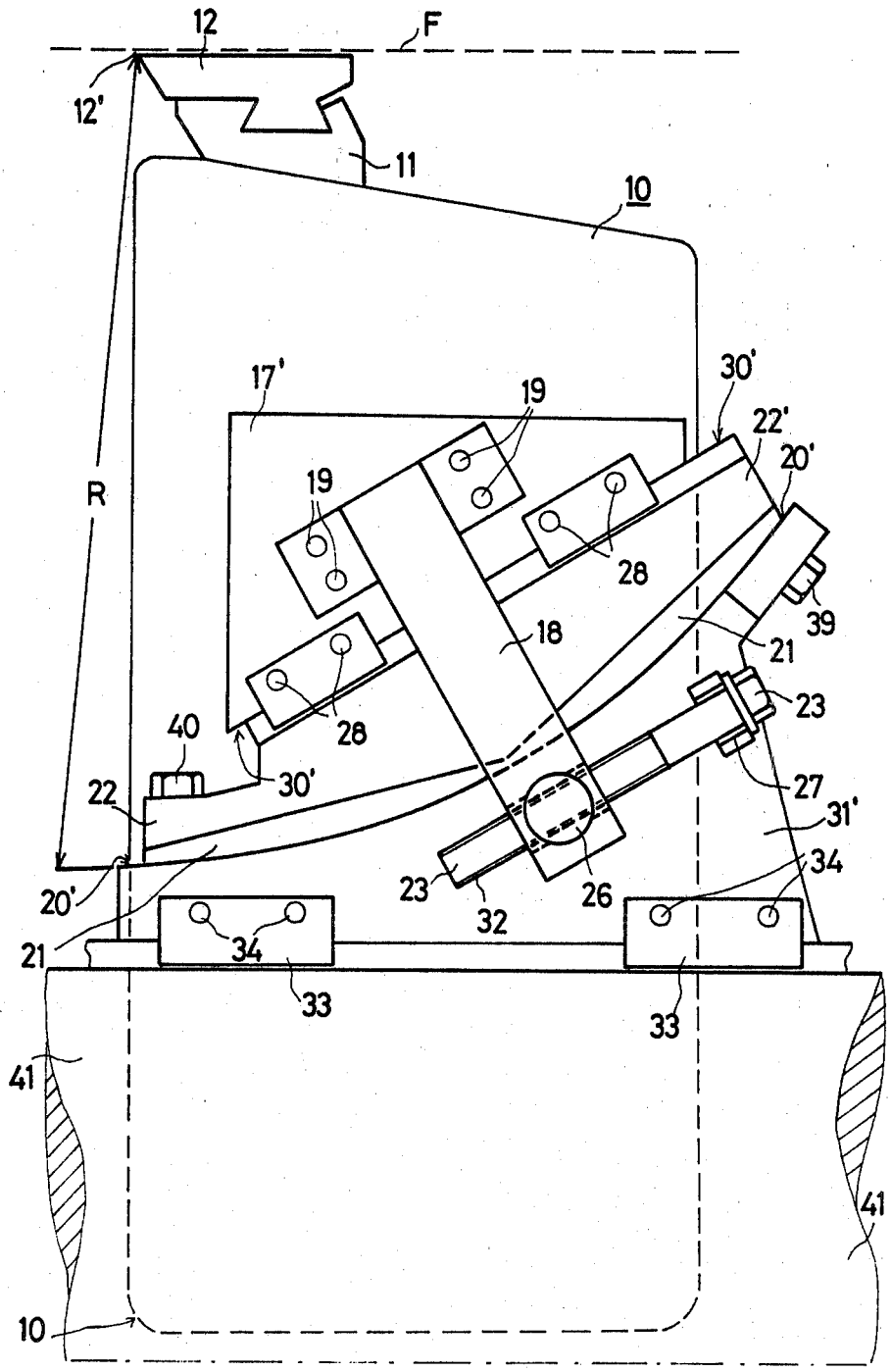
FIG. 2 is a schematic elevation view of a modification of the embodiment illustrated in FIG. 1 and, in particular, wherein the curved and straight slide surfaces are reversed in position with respect to the embodiment illustrated in FIG. 1.

A second embodiment of the control apparatus of the present invention is illustrated in FIG. 2. This embodiment of the control apparatus is essentially similar to that illustrated in FIG. 1 and the same reference numerals have been utilized in connection with similar parts having similar functions to those of the FIG. 1 embodiment. The second embodiment of the invention differs from that illustrated in FIG. 1 in that the slide surfaces 20 and 30 have been reversed. As seen in FIG. 2, the straight sliding surfaces 30' by the aid of which the height position H of the foil member 12 is adjusted, are provided on the upper slide member 17' and on the upper part of the intermediate slide member 22'. Similarly, the curved sliding surfaces 20' which function to provide the adjustment of the angular orientation $\alpha$ of the foil member 12 are provided on the lower part of the intermediate slide member 22' and the lower slide member 31'. In all other respects, the design and operation of the embodiment illustrated in FIG. 2 is similar to that described in connection with the embodiments illustrated in FIGS. 1 and 3.

It will be seen from the foregoing that the present invention provides a structurally simple yet sturdy foil strip position control apparatus wherein the adjustment of the angular orientation or clearance angle $\alpha$ and of the height H of the foil devide can be effected completely independently of each other. Moreover, in the illustrated embodiment, both adjustments can be effected utilizing a single control screw or similar adjustment means.

However, it is understood that it is within the scope of the present invention to also provide apparatus wherein the clearance angle $\alpha$ and the height H are adjusted by separate adjusting apparatus.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for controlling the position and location of a stationary device which constitutes a component of a paper machine and which acts on a paper web being manufactured therein over a transverse dimension thereof relative to the direction of travel of the web, said control apparatus being operative to control one or both of the distance of the device from the web and the angular orientation of the device, the device including a frame portion which is carried at each respective transverse end thereof by frame structure of the paper machine through a respective control apparatus, said control apparatus comprising:

a slide assembly including, a first slide member supporting a respective end of the frame portion of the stationary device and having a sliding surface;

a second slide member supported by the paper machine frame structure and having a sliding surface; and an intermediate slide member having two sliding surfaces, said intermediate slide member being situated between said first and second slide members and forming a first pair of sliding surfaces with the first slide member and a second pair of sliding surfaces with the second slide member;

wherein one pair of sliding surfaces presented by said intermediate slide member and one of said first and second slide members have a curved segment configuration having a center of curvature which is substantially coincident with or immediately adjacent to a straight edge defining a tip of the stationary device;

wherein the other pair of sliding surfaces presented by said intermediate slide member and the other of said first and second slide members have a linear configuration extending in the direction of movement thereof; and wherein said control apparatus further includes adjusting means for moving said one of said first and second slide members and intermediate slide member with respect to each other on said curved sliding surfaces to control the angular orientation of the stationary device and for moving said other of said first and second slide members and intermediate slide member with respect to each other on said linear sliding surfaces to control the distance of the stationary device from the web independently of the angular orientation of the stationary device.

2. The combination of claim 1 wherein said adjusting means comprise a single adjusting assembly which controls both the angular orientation of the stationary device as well as the distance of the stationary device from the web.

3. The combination of claim 2 wherein said adjusting assembly comprises a control screw and a connecting member, said control screw being mounted for free rotation on the second slide member, said control screw having a threaded portion which threadedly engages said connecting member, and wherein the connecting member is fixed to the first slide member.

4. The combination of claim 1 wherein the sliding surface of said first slide member has a cylindrical segment configuration.

5. The combination of claim 1 wherein the sliding surface of said second slide member has a cylindrical segment configuration.

6. The combination of claim 1 wherein that pair of sliding surfaces having a curved segment configuration has a cylindrical segment configuration.

7. The combination of claim 1 further including means for locking said intermediate slide member to that one of said first and second slide members which has a curved segment configuration so that the same are fixed with respect to each other, whereby adjustment of the distance of the stationary device from the web is effected by sliding the intermediate slide member with respect to that one of said first and second slide members having a linear sliding surface.

8. The combination of claim 7 further including means for locking said intermediate slide member to said other of said first and second slide members which has a linear configuration so that the same are fixed with respect to each other, whereby adjustment of the angular orientation of the stationary device is effected by sliding the intermediate slide member with respect to that one of said first and second slide members having a curved segment sliding surface.

9. The combination of claim 1 further including means for locking said intermediate slide member to that one of said first and second slide members which has a linear configuration so that the same are fixed with respect to each other, whereby adjustment of the angular orientation of said stationary device is effected by sliding the intermediate slide member with respect to that one of said first and second slide members having a curved segment sliding surface.

* * * * *